US007879219B2

(12) United States Patent
Fray et al.

(10) Patent No.: US 7,879,219 B2
(45) Date of Patent: Feb. 1, 2011

(54) ELECTROCHEMICAL PROCESSING OF SOLID MATERIALS IN FUSED SALT

(75) Inventors: Derek John Fray, Cambridge (GB); Robert Charles Copcutt, Cambridge (GB)

(73) Assignee: Metalysis Limited (GB)

( * ) Notice: Subject to any disclaimer, the term of this patent is extended or adjusted under 35 U.S.C. 154(b) by 1402 days.

(21) Appl. No.: 10/497,567

(22) PCT Filed: Dec. 2, 2002

(86) PCT No.: PCT/GB02/05414

§ 371 (c)(1),
(2), (4) Date: Feb. 4, 2005

(87) PCT Pub. No.: WO03/048399

PCT Pub. Date: Jun. 12, 2003

(65) Prior Publication Data

US 2006/0086621 A1 Apr. 27, 2006

(30) Foreign Application Priority Data

Dec. 1, 2001 (GB) ..... 0128816.6

(51) Int. Cl.
*C25F 3/00* (2006.01)
*C30B 9/14* (2006.01)
*C25C 3/36* (2006.01)

(52) U.S. Cl. ..... 205/363; 205/366; 205/371; 205/372; 205/387

(58) Field of Classification Search ..... 205/363–372, 205/387
See application file for complete search history.

(56) References Cited

U.S. PATENT DOCUMENTS 5,211,775 A 5/1993 Fisher et al.

(Continued)

FOREIGN PATENT DOCUMENTS

GB 13759 0/1904

(Continued)

OTHER PUBLICATIONS

Chen, G. Z. et al. "Direct electrochemical reduction of titanium dioxide to titanium in molten calcium chloride" *Nature*, Sep. 21, 2000, pp. 361-364, vol. 407.

(Continued)

*Primary Examiner*—Arun S Phasge
(74) *Attorney, Agent, or Firm*—Saliwanchik, Lloyd & Saliwanchik

(57) ABSTRACT

The subject invention pertains to methods for processing a solid material ($M^1X$) comprising a solid solution of a non-metal species (X) in a metal or semi-metal ($M^1$) or a compound between the non-metal species and the metal or semi-metal is immersed in a molten salt ($M^2Y$). A cathodic potential is applied to the material to remove a portion of the non-metal species by electro-deoxidation. To remove the non-metal species at lower concentrations, a source of a reactive metal ($M^3$) is immersed in the molten salt and is electronically connected to the material. Reactions occur at the material, where the non-metal species dissolves in the salt, and at the reactive metal, which reacts with the non-metal species dissolved in the salt to form a reaction product more stable than a compound between the non-metal species and the metal or semi-metal ($M^1$). The non-metal species is thus removed from the solid material.

29 Claims, 2 Drawing Sheets

U.S. PATENT DOCUMENTS

| | | | | |
|---|---|---|---|---|
| 6,117,208 | A | 9/2000 | Sharma | |
| 6,527,938 | B2 | 3/2003 | Bales et al. | |
| 6,540,902 | B1 | 4/2003 | Redey et al. | |
| 6,712,952 | B1 * | 3/2004 | Fray et al. | 205/640 |
| 2003/0108659 | A1 | 6/2003 | Bales et al. | |

FOREIGN PATENT DOCUMENTS

| | | | |
|---|---|---|---|
| GB | 626636 | | 7/1949 |
| GB | 635267 | | 4/1950 |
| JP | 11142585 | | 5/1999 |
| JP | 2000345252 | | 12/2000 |
| WO | WO 98/14622 | A1 | 4/1998 |
| WO | WO 99/64638 | A1 | 12/1999 |
| WO | WO 01/41152 | A2 | 6/2001 |
| WO | WO 01/62994 | A1 | 8/2001 |
| WO | WO 01/62995 | A1 | 8/2001 |
| WO | WO 01/62996 | A1 | 8/2001 |
| WO | WO 03/008670 | A2 | 1/2003 |
| WO | WO 03/046258 | A2 | 6/2003 |

OTHER PUBLICATIONS

Ferro, P. D. et al. "Application of Ceramic Membrane in Molten Salt Electrolysis of $CaO-CaCl_2$" *Waste Management*, 1997, pp. 451-461, vol. 17, No. 7.

Hirota, K. "Electrochemical deoxidation of RE-O (RE=Gd, Tb, Dy, Er) solid solutions" *Journal of Alloys and Compounds*, 1999, pp. 101-108, vol. 282.

Okabe, T. H. et al. "Thermodynamic Properties of Ln-O (Ln=La, Pr, Nd) Solid Solutions and Their Deoxidation by Molten Salt Electrolysis" *Shigen-Lo-Sozai*, 1998, pp. 813-818, vol. 114.

Okabe, T. H. et al. "Production of niobium powder by electronically mediated reaction (EMR) using calcium as a reductant" *Journal of Alloys and Compounds*, 1999, pp. 200-210, vol. 288.

Okabe, T. H. et al. "Preparation and characterization of extra-low-oxygen titanium" *Journal of Alloys and Compounds*, 1992, pp. 43-56, vol. 184.

Okabe, T. H. et al. "Deoxidation of Titanium Aluminide by Ca-Al Alloy under Controlled Aluminum Activity" *Metallurgical Transactions B*, Oct. 1992, pp. 583-590, vol. 23B, No. 5.

Okabe, T. H. et al. "Electrochemical Deoxidation of Titanium" *Metallurgical Transactions B*, Jun. 1993, pp. 449-455, vol. 24B.

Okabe, T. H. et al. "Electrochemical deoxidation of yttrium—oxygen solid solutions" *Journal of Alloys and Compounds*, 1996, pp. 150-154, vol. 237.

Oki, T. et al. "Reduction of Titanium Dioxide by Calcium in Hot Cathode Spot" *Department of Metallurgical Engineering*, May 31, 1967, pp. 164-166.

Opie, W. R. et al. "A Basket Cathode Electrolytic Cell for Production of Titanium Metal" *Transactions of the Metallurgical Society of AIME*, Aug. 1960, pp. 646-649, vol. 218.

Swinkels, D. A. J. "Thermal Batteries" In *Advances in Molten Salt Chemistry 1*, ed. J. Braustein et al., 1971, pp. 188-191, Plenum Press.

Mishra, B. et al. "Diffusion Coefficient of Oxygen Ions in Molten Calcium Chloride" 9th Symposium on Molten Salts, *Electrochem. Soc.*, 1994, pp. 697-704.

Mishra, B. et al. "Application of Molten Salts in Pyrochemical Processing of Reactive Metals" *Molten Salts*, Electrochem. Soc., 1992, pp. 184-203, vol. 92-16, ed. R. J. Gale et al.

"Extra-low oxygen titanium@ prodn.—by heating mixt. of titanium@ raw material and high purity flux, removing flux with acid and discharging, for structural part" 1992, XP-002244274, abstract only.

Ward, R. G. et al. "The Electrolytic Removal of Oxygen, Sulphur, Selenium, and Tellurium from Molten Copper" *Journal of the Institute of Metals*, 1961-1962, pp. 6-12, vol. 90.

Takeuchi, S. et al. "Studies in the electrolytic reduction of titanium dioxide and titanium slag" *Nippon Kinzoku Gakkaishi*, 1964, pp. 549-554, vol. 28, No. 9.

"Synopsis of Periodical Literature" In *Electrochemical and Metallurgical Industry*, Jan. 1905, pp. 35-40.

* cited by examiner

ELECTROCHEMICAL PROCESSING OF SOLID MATERIALS IN FUSED SALT

This application is the U.S. national stage application of International patent application No. PCT/GB02/05414, filed Dec. 2, 2002.

FIELD OF THE INVENTION

This invention relates to a method and an apparatus for processing materials by removing non-metal species from metals and semi-metals and their compounds and alloys. The invention also relates to metals, semi-metals, alloys and intermetallic compounds so produced. In particular the invention relates to the direct production of metals and semi-metals by the removal of oxygen or other non-metal species from oxides or other compounds, and the purification of metals and semi-metals by the removal of dissolved oxygen or other non-metal species.

BACKGROUND TO THE INVENTION

This document relates to the processing of metals and semi-metals, or metalloids, and their compounds and alloys, but to avoid repetition reference is made only to metals in most instances. The skilled person would readily appreciate, however, that in such cases the term metal should be interpreted to encompass both metals and semi-metals or metalloids.

Many metals form oxides, and some have a significant solubility for oxygen. In many cases, dissolved oxygen is detrimental and therefore needs to be reduced or removed before the metal can be fully exploited for its mechanical or electrical properties. For example, titanium, zirconium and hafnium are highly reactive elements and rapidly form an oxide layer when exposed to oxygen-containing environments, even at room temperature. This passivation is the basis of their outstanding corrosion resistance under oxidising conditions. However, this high reactivity has attendant disadvantages which have dominated the extraction and processing of these metals.

As well as oxidising at high temperatures in the conventional way to form an oxide scale, titanium and other elements have a significant solubility for oxygen and other metalloids (e.g. carbon and nitrogen) which results in a serious loss of ductility. This high reactivity of titanium and other Group IVA elements extends to reaction with refractory materials such as oxides, carbides etc. at elevated temperatures, again contaminating and embrittling the basis metal. This behaviour is extremely deleterious in the commercial extraction, melting and processing of the metals concerned.

Typically, extraction of a metal from its oxide is achieved by heating the oxide in the presence of a reducing agent (the reductant). The choice of reductant is determined by the comparative thermodynamics of the oxide and the reductant, specifically the free energy balance in the reducing reaction. This balance must be negative to provide the driving force for the reduction to proceed.

The reaction kinetics are influenced principally by the temperature of reduction and by the chemical activities of the components involved. The latter is often an important feature in determining the efficiency of the process and the completeness of the reaction. For example, it is often found that although a particular reduction should in theory proceed to completion, the kinetics are considerably slowed down by the progressive lowering of the activities of the components as the reduction progresses. In the case of an oxide source material, this may result in a residual content of oxygen (or other impurity elements which may be present) which can be deleterious to the properties of the reduced metal, for example, by lowering ductility, etc. This frequently leads to the need for further operations to refine the metal and remove the final residual impurities to achieve high quality metal.

Because the reactivity of Group IVA elements is high, and the deleterious effect of residual impurities serious, extraction of these elements is not normally carried out from the oxide but, following preliminary chlorination, by reducing the chloride. Magnesium or sodium are often used as the reductant. In this way, the deleterious effects of residual oxygen may be avoided. This more complex process inevitably leads, however, to higher costs which make the final metal more expensive, limiting its applications and its value to a potential user.

Despite the use of this process, contamination with oxygen still occurs. During processing of metals at high temperatures, for example, a hard layer of oxygen-enriched material is often formed beneath a conventional oxide scale. In titanium alloys this is often called the "alpha case", from the stabilising effect of dissolved oxygen on the alpha phase in alpha-beta alloys. If this layer is not removed, subsequent processing at room temperature can lead to the initiation of cracks in the hard and relatively brittle alpha-case surface layer. These can then propagate into the body of the metal, beneath the alpha case. If the hard alpha case or cracked surface is not removed before further processing of the metal, or before the fabricated product enters service, there can be a serious reduction in performance, especially of fatigue properties. Heat treatment in a reducing atmosphere is not available as a means of overcoming this problem for Group IVA metals because of the embrittlement of these metals by hydrogen and because the oxide or "dissolved oxygen" cannot be sufficiently reduced or minimised. The commercial costs arising from this problem are significant.

In practice, for example, metal is often cleaned up after hot working by removing the oxide scale by mechanical grinding, grit-blasting, or using a molten salt, and then by acid pickling, often in $HNO_3$/HF mixtures, to remove the oxygen-enriched layer of metal beneath the scale. These operations are costly in terms of loss of metal yield, consumables and not least in effluent treatment. To minimise scaling and the costs associated with the removal of the scale, hot working is generally carried out at as low a temperature as is practical. This, however, reduces plant productivity, and increases the load on the plant due to the reduced workability of the metal at lower temperatures. All of these factors increase the processing costs.

In addition, acid pickling is not always easy to control, either in terms of hydrogen contamination of the metal, which leads to serious embrittlement problems, or in terms of surface finish and dimensional control. The latter is especially important in the production of thin materials such as thin sheet, fine wire, etc.

It is evident therefore, that a process which can remove the oxide layer from a metal and additionally the dissolved oxygen of the sub-surface alpha case, without the grinding and pickling described above, could have considerable technical and economic benefits on metal processing and metal extraction.

Such a process may also have advantages in ancillary steps of the purification treatment or processing of metals. For instance, scrap turnings produced during either the mechanical removal of the alpha case, or machining of a product to finished size, are difficult to recycle due to their high oxygen content and consequent hardness, and the resulting effect on the chemical composition and hardness of the metal into which they are recycled.

Even greater advantages might accrue if a metal which had been in service at elevated temperatures and had therefore been oxidised or contaminated with oxygen could be rejuvenated by a simple treatment. For example, the life of an aero-engine compressor blade or disc made from titanium alloy is constrained, to a certain extent, by the depth of the alpha case layer which forms during fabrication and during service and the consequent dangers of surface crack initiation and propagation into the body of the disc leading to premature failure. In this instance, acid pickling and surface grinding are not possible since a loss of dimension could not be tolerated. A technique which lowered the dissolved oxygen content without affecting the overall dimensions of a component, especially in complex shapes such as blades or compressor discs, would have obvious and very important economic benefits. In an aero-engine, for example, because of the effect of temperature on thermodynamic efficiency, these benefits would be compounded if they allowed the discs to operate not just for longer times at the same temperature, but also possibly at higher temperatures where greater fuel efficiency of the aero-engine can be achieved.

In addition to titanium, a further metal of commercial interest is Germanium, which is a semi-conducting semi-metal, or metalloid, element found in Group IVB of the Periodic Table. It is used, in a highly purified state, in infra-red optics and electronics. Oxygen, phosphorus, arsenic, antimony and other metalloids are typical of the impurities which must be carefully controlled in Germanium to ensure adequate performance. Silicon is a similar semiconducting element and its electrical properties depend critically on its purity content. Controlled purity of the parent silicon or germanium in fabricating devices is fundamentally important to provide a secure and reproducible basis onto which the required electrical properties can be built up in computer chips, etc.

U.S. Pat. No. 5,211,775 discloses the use of calcium metal to deoxidise titanium. Okabe, Oishi and Ono (Met. Trans B. 23B (1992):583, have used a calcium-aluminium alloy to deoxidise titanium aluminide. Okabe, Nakamura, Oishi and Ono (Met. Trans B. 24B (1993):449) describe the removal of oxygen dissolved in solid titanium by electrochemically producing calcium from a calcium chloride melt, on the surface of the titanium-oxygen solid solution. Okabe, Devra, Oishi, Ono and Sadoway (Journal of Alloys and Compounds 237 (1996) 150) have deoxidised yttrium using a similar approach.

Ward et al, Journal of the Institute of Metals (1961) 90:6-12, describes an electrolytic treatment for the removal of various contaminating elements from molten copper during a refining process. The molten copper is treated in a cell with barium chloride as the electrolyte. The experiments show that sulphur can be removed using this process. However, the removal of oxygen is less certain, and the process requires the metal to be molten, which adds to the overall cost of the refining process. The process is therefore unsuitable for a metal such as titanium which melts at 1660° C., and which has a highly reactive melt.

PCT/GB99/01781 describes an electrolytic method, termed electro-deoxidation, for the removal of oxygen and other non-metal species from a sample of a solid metal or metal compound by making the sample the cathode in a calcium chloride melt. Taking as an example the treatment of a metal or metal compound containing oxygen, when a cathodic potential below the potential for deposition of calcium from the calcium chloride was applied, the oxygen in the sample preferentially ionised.

SUMMARY OF INVENTION

The invention provides a method and an apparatus for processing metals and semi-metals and their compounds and alloys, and the products of the method and apparatus, as defined in the appended independent claims. Preferred or advantageous features of the invention are set out in dependent sub-claims.

As mentioned above, the following text uses the term "metals". As the skilled person will appreciate, this term should be taken where appropriate to encompass metals, semi-metals and metalloids.

The inventor has appreciated that in the prior art publication PCT/GB99/01781 discussed above, a problem arises due to an inefficiency during electro-deoxidation to remove non-metal species (X) at low or reduced concentrations. PCT/GB99/01781, which is incorporated herein by reference, describes the electro-deoxidation of solid solutions of non-metal species in metals ($M^1$) and of solid compounds between non-metal species and metals. In an example, a sample of a material comprising of a solid solution or solid compound (both termed $M^1X$) is arranged as the cathode in a melt comprising a salt or a mixture of salts ($M^2Y$) containing one or more cations ($M^2$) and one or more anions (Y). A cathodic potential is then applied to the material, causes dissolution of the non-metal species in the melt, and typically its subsequent evolution at an anode.

This technique generally shows good current and energy efficiency for metal compounds and for metals containing high concentrations of oxygen or other non-metal species. As electro-deoxidation progresses, however, the inventor has appreciated that the efficiency tends to drop as the concentration of oxygen or other non-metal species reduces. It is considered by the inventor that this may be because of current passing as electrons through the melt.

The inventor has also appreciated that this problem of reducing efficiency may be addressed by using the reactive metal technique described below in combination with the electro-deoxidation technique.

The present invention may therefore advantageously provide a method for processing metals and their compounds and alloys by initially applying the electro-deoxidation technique and then additionally applying, or changing over to, the reactive metal technique as the efficiency of the electro-deoxidation drops. Alternatively, in some circumstances it may be appropriate to operate both techniques at the same time throughout the processing.

In a preferred embodiment, the cathodic potential applied to the material is less than the potential for the deposition of a cation, or any cation, from the melt at the cathode.

The term electro-deoxidation is used herein to describe the process of removing the non-metal species (X) from a solid material, such as a compound or a solid solution, by contacting the material with the melt and applying a cathodic voltage to it such that the non-metal species, or anionic species, dissolves. In electrochemistry, the term oxidation implies a change in oxidation state and not necessarily a reaction with oxygen. It should not, however, be inferred that electro-deoxidation always involves a change in the oxidation states of both (or all) of the components of the compound; this is believed to depend on the nature of the compound, such as whether it is primarily ionic or covalent. In addition, it should not be inferred that electro-deoxidation can only be applied to an oxide; any compound may be processed in this way. Other terms to describe the electro-deoxidation process in particular instances may be electro-decomposition, electro-reduction or solid-state electrolysis.

The Reactive Metal Technique

The reactive metal technique involves the removal of a non-metal species (X) from a metal solid solution or a solid metal compound (termed $M^1X$ in both cases). The technique involves contacting a material comprising the solid solution or solid compound ($M^1X$) with a melt comprising a salt or a mixture of salts, which in the present case is advantageously, though not essentially, the same as the melt used in the electro-deoxidation process described above. The melt also contacts or contains in solution a second, reactive metal ($M^3$), different from $M^1$. The reactive metal may or may not be the same as the cation or one of the cations ($M^2$)in the melt.

The reactive metal method is based upon the realisation that a metal ($M^3$) which forms a more stable compound or solid solution with a non-metal species (X) may be able to reduce or purify a less stable solid solution or compound ($M^1X$) of the metal ($M^1$), in a preferred embodiment even proceeding far enough to extract, or purify the sample to, the metal ($M^1$). During application of the method, at the sample the non-metal species dissolves in the melt and then reacts with the reactive metal to form the reaction product more stable than the solid material ($M^1X$). The metal $M^3$ is here termed a reactive metal, as being more reactive (with the non-metal species (X) under the reaction conditions) than the metal $M^1$.

Furthermore, in a preferred embodiment if the melt has any, or sufficient, electronic conductivity, there may be no need to make a direct electrical connection between the reactive metal ($M^3$) and the solid solution or compound ($M^1X$) as the electronic current required to enable the reaction can flow through the melt. Alternatively, electrical contact may advantageously be made between $M^3$ and $M^1X$, for example by means of an external circuit. Such an electrical connection may be advantageous or even necessary if the molten salt has low electronic conductivity.

Thus, during implementation of the reactive metal method a preferred embodiment of the invention may provide a method for removing a non-metal species (X) from solid solution in a metal or from a metal compound ($M^1X$) by placing the solid solution or compound in a molten salt ($M^2Y$) containing a reactive metal ($M^3$), in which the reaction product ($M^3X$) is more stable than the solid solution or compound so that the non-metal species is removed from the solid solution or compound.

Advantageously, $M^2Y$ is more stable than either $M^1Y$ or $M^3Y$, and $M^2X$ is more stable than $M^1X$ and as stable or more stable than $M^3X$.

General Aspects of the Invention

In general terms, the invention may advantageously be carried out as follows. A sample of a solid solution or a solid compound ($M^1X$) is contacted with the molten salt ($M^2Y$). A cathodic potential is applied to the material to remove a portion of the non-metal species by electro-deoxidation. As this reaction proceeds it becomes less efficient and so at a predetermined point a source of a reactive metal ($M^3$) is contacted with or dissolved in the molten salt and, if required, is electronically connected to the sample, either by electronic conduction through the salt or through an external circuit. The material of the sample may thus advantageously be purified or reduced to produce the metal or semi-metal ($M^1$), or at least to reduce its content of the non-metal species (X).

In a preferred embodiment a metal compound ($M^1X$) such as, for example, a sample of a metal oxide may be arranged as the cathode in a molten salt electrolyte ($M^2Y$). A cathodic potential which is preferably, but not essentially, below the potential for cation deposition from the electrolyte is then applied. The oxygen in the sample begins to dissolve in the melt, is transported to an anode and evolves as oxygen gas. Initially, electro-deoxidation may be fast and efficient but as the sample is reduced and the oxygen content falls, the efficiency falls. At a predetermined point, the reactive metal process may advantageously be started and the electro-deoxidation optionally discontinued. The reactive metal process may involve immersing a reactive metal ($M^3$) in the melt so that it reacts with the oxygen (X) as described above to remove more oxygen from the sample ($M^1X$). An electrical connection between the reactive metal and the sample may be needed unless the melt has sufficient electrical conductivity, as described above.

It is believed that the mechanisms behind the invention may be as follows. Using treatment of a metal oxide as an example, during electro-deoxidation the metal oxide may rapidly and efficiently be converted to a solid solution of oxygen dissolved in the metal. Removal of further oxygen from the oxygen-saturated metal by electro-deoxidation may be slower as it requires diffusion of oxygen in the metal phase. During this slower removal of oxygen, if electro-deoxidation is continued the current flow may be high as a significant part of the current may not be ionic but probably electronic. This causes current and energy inefficiency. Changing over to the reactive metal technique at this stage may improve efficiency by eliminating the electronic part of the conduction driven by the external voltage applied during electro-deoxidation. If a reactive metal is simply immersed in the melt, then no externally-driven electronic current flows. If electrolysis is used to generate the reactive metal, an external voltage is used but electrolytic generation of the reactive metal may advantageously be much more efficient than continued electro-deoxidation.

When considering the commercial application of embodiments of the present invention it may be found that an advantage of using the reactive metal technique in combination with electro-deoxidation lies in the overall speed of processing. If electro-deoxidation becomes inefficient at lower concentrations of the non-metal species, the added cost of supplying current which is not effectively used in electro-deoxidation may not be significant, as the cost of the current may be low, but the speed of reaction may drop significantly. By contrast the cost of the reactive metal may be high, although it may be efficiently produced by electrolysis if desired, but it is anticipated that the overall time taken to remove the non-metal species from the material may be advantageously reduced by the method of the invention.

It is considered that the reactive metal method of the invention operates as follows. When a metal, $M^3$, which has a reactivity greater than that of $M^1$ but less than or equal to that of $M^2$, is connected electrically to $M^1X$, $M^3$ ionises according to the following reaction.

$$(M^3) \rightarrow (M^3)^+ + e^-$$

The electrons move to $M^1X$ (either through the salt or through an external connection, as described above) and the following reaction occurs.

$$e^- + X \rightarrow X^-$$

($M^{3+}$) then reacts with $X^-$ to form $M^3X$, which may precipitate. For the reactions to proceed, it may be necessary for X to diffuse to the surface of $M^1$ and, depending on the temperature, this can be a slow process. For the best results, it may therefore be advantageous to carry out the reaction at a suitably elevated temperature In a further aspect of the invention, the reactive metal may not be immersed directly in the melt but may be obtained by electrolysing the melt or a component of the melt. For example, if the melt is $CaCl_2$ then CaO may be added, dissolved in the melt, and electrolysed to generate Ca at a cathode and O, or $O_2$ gas, at an anode. Advantageously the anode may be the same as the anode used during the electro-deoxidation of the solid solution or compound ($M^1X$) and the cathode a separate cathode provided for generating the reactive metal.

When the reactive metal has been generated, an electrical connection between the solid solution and the reactive metal may be made in order to enable the reaction between the reactive metal and the oxygen to proceed, unless the melt has sufficient electrical conductivity as described above.

When the reactive metal is the same as the cation in the melt, the reactive metal may be able to dissolve in the salt. For example, if the reactive metal is calcium and is added to, or is deposited by electrolysis from, a melt comprising calcium chloride or a mixture of calcium chloride and calcium oxide, the calcium can dissolve in the melt and form a solution. This calcium-rich solution can then be used to carry out the reactive metal method. In more general terms, the reactive metal may be used in the form of a solution of the metal in the melt. In this aspect of the invention, no external electrical connection between the reactive metal and the solid solution or compound may be needed for the reactive metal process.

In a further aspect of the invention in order to implement the reactive metal process the melt, or a component of the melt, may be electrolysed to deposit the reactive metal directly on to the surface of the solid solution or solid compound ($M^1X$). This may be achieved for example by changing the voltage or current applied to the cell or by adding to the melt a further salt which can be electrolysed as required. In this embodiment, in the same way as for the embodiment in which the reactive metal is dissolved in the melt, no external electrical connection between the reactive metal and the solid solution or compound would be needed for the reactive metal process. There may, however, be a risk of contamination of the product of the process by the reactive metal for certain combinations of materials.

An advantage of generating the reactive metal physically spaced from the solid solution or compound as described above may be the reduction of contamination of the product.

In all aspects of the invention, various advantageous features are as follows.

The starting material for the method of the invention may be a solid metal compound, such as an oxide, which is advantageously easily available.

Advantageously, $M^1X$ may be a surface coating on a body of $M^1$, or on a body of a different metal or other material.

In a further preferred embodiment, the non-metal or anionic species (X) is any one or more of O, S, N, $CO_3$, $SO_4$, $PO_4$, $NO_2$ or $NO_3$. The non-metal species may also comprise C.

In principle, other reactions involving the reduction and dissolution of other metalloids, such as phosphorus, arsenic, antimony etc. could also take place using the method of the invention.

In a still further preferred embodiment, $M^1$ may comprise any metallic element or alloy. Particularly preferably, $M^1$ comprises any of Ti, Si, Ge, Zr, Hf, Sm U, Pu, Al, Mg, Nd, Mo, Cr, Nb, or any alloy thereof.

A further metal ($M^N$), or solid solution or compound ($M^NX$) may be present in which case the product of the method of the invention may be an alloy of the metallic elements $M^1$ and $M^N$. In a preferred embodiment, for example, treatment of a mixture of powders, or a solid solution, comprising $M^1$ and $M^N$ in the form of metals, solid solutions or compounds will produce an alloy of $M^1$ and $M^N$ or an intermetallic.

To obtain a molten salt $M^2Y$ with a low melting point, a mixture of salts, such as a eutectic mixture, can be used.

In preferred embodiments, the invention may be used either to extract dissolved oxygen from a metal, for example to remove an alpha case, or may be used to remove the oxygen from a metal oxide. If a mixture of oxides or other compounds, or other mixture comprising two or more metal species, is used, the reduction process may cause an alloy to form.

This invention may also be used to remove dissolved oxygen or other dissolved elements as mentioned above, e.g. sulphur, nitrogen, and carbon from other metals or semi-metals, e.g. germanium, silicon, hafnium and zirconium. The invention may also advantageously be used to decompose oxides or other compounds of elements such as titanium, uranium, magnesium, aluminium, zirconium, hafnium, niobium, molybdenum, plutonium and other actinides, neodymium, samarium and other rare earths. When mixtures of oxides or compounds are reduced, advantageously an alloy of the reduced metals may form.

$M^2Y$ may be any suitable metal salt or mixture of salts, e.g. $M^2$ may be one or more of Ca, Ba, Li, Cs, Mg or Sr and Y may be one or more of Cl or F.

The process for carrying out the invention may advantageously be more direct and cheaper than the more usual reduction and refining processes used currently.

The material for treatment using the invention may be in the form of single crystals or slabs, sheets, wires, tubes, etc., commonly known as semifinished or mill-products, during or after production; or alternatively in the form of an artefact made from mill-product such as by forging, machining, welding, or a combination of these, before, during or after service. The material may also be in the form of shavings, swarf, grindings or some other by-product of a fabrication process. Alternatively, the material, such as a metal oxide or other compound, may be applied to a metal substrate prior to treatment; e.g. $TiO_2$ may be applied to steel and subsequently reduced to the titanium metal.

In a preferred embodiment the material for treatment may be prepared in the form of powder, pellets, porous blocks or granules. Particularly advantageously the material may be provided as a powder and formed into pellets, porous blocks or granules by powder processing techniques such as slip casting and sintering.

The material to be treated may show at least some initial metallic conductivity. If it does not, then it should be placed in contact with a conductor, which during electro-deoxidation allows application of the cathode potential and during reactive metal processing may comprise an external connection to the reactive metal, $M^3$, or the melt itself if the melt allows electrical conduction.

SPECIFIC EMBODIMENTS AND BEST MODE OF THE INVENTION

Specific embodiments of the invention will now be described by way of example, with reference to the drawings, in which.

Figure 1:
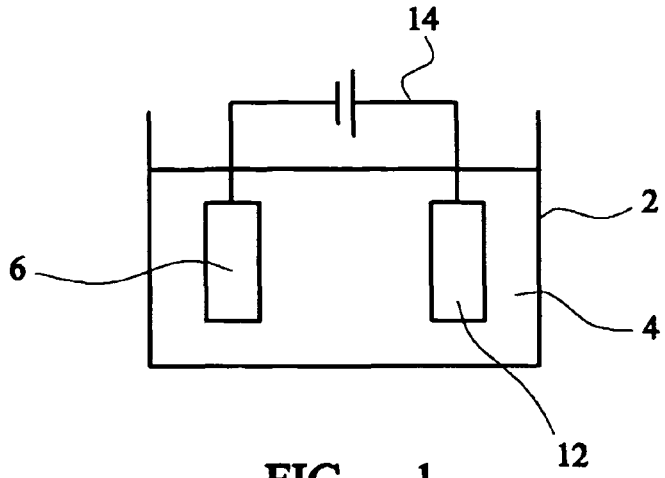
FIG. 1 illustrates an apparatus according to a first embodiment of the invention during electro-deoxidation.

FIG. 1 shows a cell 2 containing a calcium chloride melt 4. In the melt are immersed a sample 6 of titanium dioxide and an inert anode 12. A voltage of about 2.5 to 3.3V is applied through an external circuit 14 between the sample 6, which forms a cathode, and the anode. The titanium dioxide is an electrical insulator and is contacted with an inert conductor to enable the electro-deoxidation. This can be achieved in a variety of ways, such as slip-casting, and optionally sintering, titanium dioxide powder to form a solid, but porous, sample around a conductor core, or by placing titanium dioxide pellets in an inert, conducting basket. These techniques are known from the prior art, including PCT/GB99/01781.

When electro-deoxidation slows, as the oxygen content drops as described above, it is thought that electronic conduction driven through the melt by the electro-deoxidation potential increases and the efficiency of the process consequently drops. At a predetermined point, for example at a predetermined current or a predetermined rate of oxygen evolution at the anode, the electro-deoxidation potential is removed and the apparatus switched to the configuration shown in FIG. 2.

Figure 2:
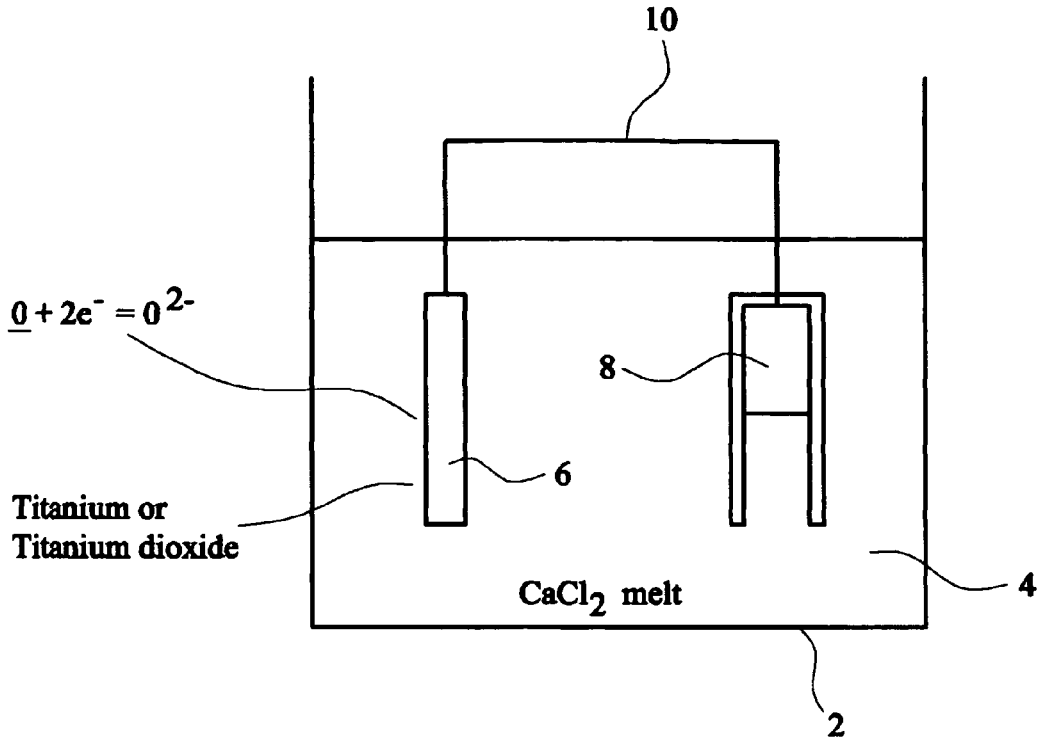
FIG. 2 illustrates the apparatus of FIG. 1 during reactive metal processing.

FIG. 2 shows the cell 2 containing the calcium chloride melt 4. In the melt are immersed the sample 6, which is now of titanium containing dissolved oxygen, and a source of calcium 8 (a reactive metal). It has been found that calcium is efficacious for treating titanium dioxide, but other reactive metals may be effective for treating other materials. The sample 6 is connected by an external electrical circuit 10 to the calcium 8. In FIG. 2 the inert anode 12 has been removed from the melt. It could alternatively be retained but takes no part in the subsequent reaction as no voltage is applied to it.

The calcium ionises according to the reaction:

$$Ca \rightarrow Ca^{2+} + 2e^{-}$$

The electrons released in this reaction travel in the external circuit to the titanium oxide. At the titanium surface, the following reaction occurs:

$$0 + 2e^{-} 32\ 0^{2-}$$

The oxygen ions diffuse through the melt to the calcium source, where the calcium ions react with the oxygen ions to form CaO. Initially, the CaO can dissolve in the melt, but will precipitate if its solubility (about 20 mole % in calcium chloride) is exceeded.

This process involves no externally-applied voltage and so no excess electronic current flows, but only the electronic current directly related to the reaction of the oxygen. Energy and current efficiency may therefore advantageously be higher than if electro-deoxidation had been continued to achieve a comparably low level of oxygen in the titanium sample.

Figure 3:
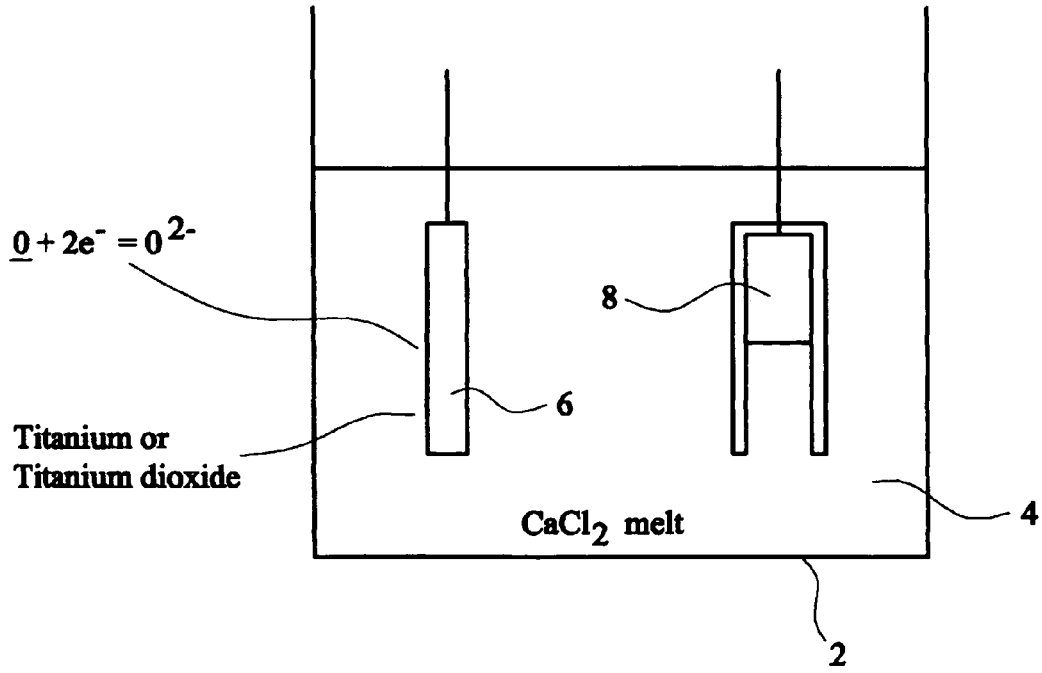
FIG. 3 illustrates an apparatus according to a second embodiment of the invention during reactive metal processing.

FIG. 3 illustrates a second embodiment. This is a variation of the reactive metal processing stage of the first embodiment in which there is no external circuit between the sample and the source of calcium in the calcium chloride melt. This variation can be used as long as the molten salt has sufficient conductivity to allow the electrons released by the anode to travel to the cathode and so allow the reaction to proceed.

Figure 4:
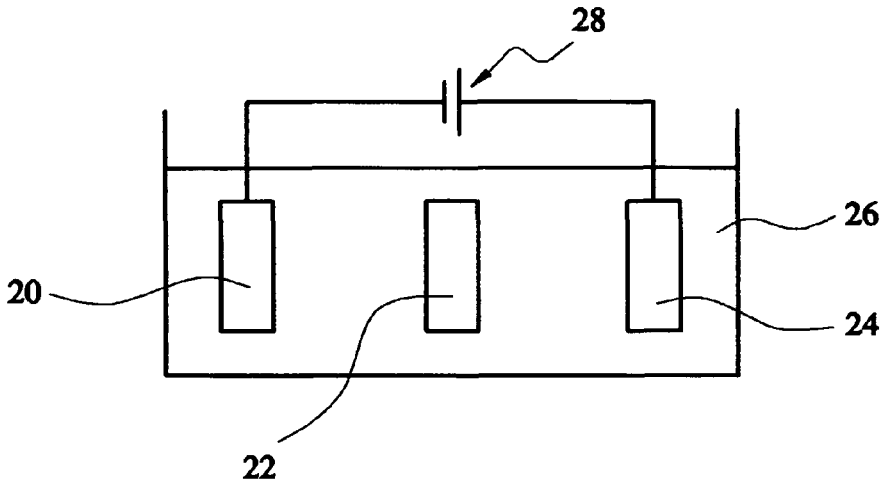
FIG. 4 illustrates an apparatus according to a third embodiment of the invention during electro-deoxidation.

In a third embodiment as illustrated in FIG. 4 a sample 20 of titanium dioxide or of titanium containing dissolved oxygen, an electrode 22 and an inert anode 24 are immersed in a calcium chloride melt 26. An electro-deoxidation voltage 28 is connected between the sample, which forms the cathode, and the anode. As in the embodiment of FIG. 1, this procedure removes oxygen from the sample and evolves oxygen gas at the anode.

Figure 5:
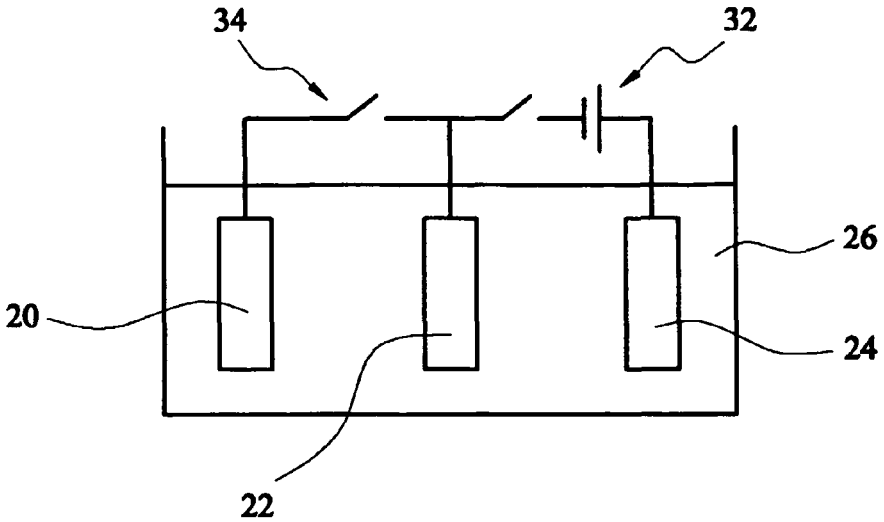
FIG. 5 illustrates the apparatus of FIG. 4 during reactive metal processing.

At a predetermined point, as in the first embodiment, the electro-deoxidation voltage is disconnected as shown in FIG. 5. Calcium oxide is then added to the melt, in which it dissolves, and the reactive metal technique is applied in two steps. In a first step, a voltage 32 is connected between the electrode 22, which forms a cathode, and the anode 24. The voltage electrolyses the calcium oxide, generating solid calcium at the electrode and oxygen at the anode.

In a second step as shown in FIG. 5, the electrolysis of the calcium oxide is discontinued and the deposited calcium is connected electronically to the sample. The calcium ionises as follows:

$$Ca \rightarrow Ca^{2+} + 2e^{-}$$

The electrons travel either through the salt or via an external wire 34 (shown in FIG. 5, but this may not be required if the salt has sufficient electronic conductivity) to the sample, which causes the oxygen in the sample to ionise:

$$O + 2e^{-} = O^{2-}$$

As in the first and second embodiments, the oxygen in the sample thus dissolves in the melt before combining with the reactive metal, calcium, at the electrode 22. The sample is thus reduced or purified to titanium metal with a reduced oxygen content.

During the reaction, calcium oxide is formed and as calcium oxide has substantial solubility in calcium chloride, it is not precipitated. When all the calcium has been consumed, it can be regenerated by repeating the step of electrolysing the calcium oxide dissolved in the electrolyte, depositing calcium on the electrode and evolving oxygen at the anode. The sample can then be treated to remove further oxygen.

Although the reactive metal process in this third embodiment has been described in terms of first and second steps, these steps may operate simultaneously. As long as calcium metal is present and is electrically connected to the sample, through either the melt or an external circuit, oxygen can be removed from the sample to react with the calcium.

In a further variation the material electrolysed to generate the reactive metal in the first step of the process need not be the same as the reaction product formed in the second step, although it is advantageous if these are the same compound as it can then be recycled by repetition of the first step as described above.

In a fourth embodiment, which is a variation of the third embodiment, the reaction product between the reactive metal and the non-metal species being removed from the sample may not be soluble in the melt. It would then precipitate out of the melt.

The specific embodiments have described the reduction and purification of titanium dioxide. The same processes are also applicable to a very wide range of metal and semi-metal compounds and solid solutions as discussed above. In addition, if a mixture of metal or semi-metal oxides or compounds, or a mixture of such materials with another metal, is used as the sample, then an alloy or compound of the metals and/or semi-metals can be formed as the product of the methods in the embodiments. For example a sample slip-cast from a mixture of powdered titanium oxide and niobium oxide can directly produce an alloy of titanium and niobium.

The invention claimed is:

1. A method for processing a solid material ($M^1X$) comprising a solid solution of a non-metal species (X) in a metal or semi-metal ($M^1$) or a compound containing the non-metal species (X) and the metal or semi-metal ($M^1$), to remove the non-metal species (X) from the solid material ($M^1X$) and thereby produce a product having a desired reduced content of the non-metal species, which comprises the steps of:

a) contacting a melt comprising a fused salt ($M^2Y$) with the solid material and with an anode and applying a cathodic potential to the solid material so that a first portion of the non-metal species is removed from the solid material;

discontinuing the process of step a) after the first portion of the non-metal species has been removed from the solid material, the removal of the first portion of the non-metal species being insufficient to produce the product having the desired reduced content of the non-metal species;

b) electronically connecting a reactive metal or semi-metal ($M^3$) to the solid material while contacting the melt ($M^2Y$) with the solid material and the reactive metal so that the reactive metal reacts with a second, further, portion of the non-metal species to form a reaction product ($M^3X$) which is more stable than a compound between the non-metal species (X) and the metal or semi-metal ($M^1$); and discontinuing the process of step b) after the second, further portion of the non-metal species has been removed from the solid material, removal of both the first portion and the second portion of the non-metal species being sufficient to produce the product having the desired reduced content of the non-metal species.

2. The method according to claim 1, in which the process of step b) is started after a portion of the non-metal species has been removed from the solid material.

3. The method according to claim 2, in which the processes of steps a) and b) operate simultaneously during at least a portion of the implementation of the method.

4. The method according to claim 1, in which the processes of steps a) and b) operate simultaneously during at least a portion of the implementation of the method.

5. The method according to claim 1, in which the solid material ($M^1X$) is a conductor.

6. The method according to claim 1, in which the solid material ($M^1X$) is an insulator or poor conductor and is used in contact with a conductor.

7. The method according to claim 1, in which the method is carried out at a temperature of from 700° C. to 1000° C.

8. The method according to claim 1, in which the salt ($M^2Y$) comprises as a cation ($M^2$) Ca, Ba, Li, Cs or Sr and as an anion (Y) Cl or F.

9. The method according to claim 1, in which the salt ($M^2Y$) comprises as a cation ($M^2$) Ca, Ba, Li, Cs or Sr.

10. The method according to claim 1, in which the salt ($M^2Y$) comprises as an anion (Y) Cl or F.

11. The method according to claim 1, in which the reactive metal ($M^3$) comprises Ca, Sr, Ba, Mg, Al or Y.

12. The method according to claim 1, in which the solid material ($M^1X$) is a surface coating on a body of the metal or semi-metal ($M^1$) or on a body of a different metal or other material.

13. The method according to claim 1, in which the non-metal species (X) comprises O, S or N.

14. The method according to claim 1, in which the melt comprises a mixture of salts.

15. The method according to claim 1, in which the metal or semi-metal ($M^1$) comprises Ti, Zr, Hf, Sm, U, Al, Mg, Nd, Mo, Cr or Nb or an alloy of any of these.

16. The method according to claim 1, in which the solid material ($M^1X$) is in the form of a porous pellet or a powder.

17. The method according to claim 1, in which a further solid material ($M^NX$, $M^N$), being a metal compound or solid solution, a semi-metal compound or solid solution, a metal or a semi-metal, is present and the product is an alloy or intermetallic compound of the metals or semi-metals.

18. The method according to claim 1, in which the reactive metal is generated in situ in the fused salt by electrolysis.

19. The method according to claim 18, in which the reactive metal is generated on a surface of the solid material.

20. The method according to claim 19, in which the reactive metal is generated on the surface of the solid material using a cathodic potential which is greater than the potential for cation deposition from the molten salt.

21. The method according to claim 18, in which the reactive metal is generated at a distance from the solid material.

22. The method according to claim 1, in which the solid material is electronically connected to the reactive metal by conduction through the melt or through an external connection.

23. The method according to claim 1, in which during step b) the reactive metal is in solution in the melt.

24. The method according to claim 1, in which the melt used in step a) is different from the melt used in step b).

25. The method according to claim 1, in which the cathodic potential during step a) is less than the potential for cation deposition from the molten salt.

26. The method according to claim 1, in which the reactive metal is the same as a cation species in the melt.

27. The method according to claim 1, wherein the processing of the solid material ($M^1X$) results in producing the metal or semi-metal ($M^1$).

28. A method for removing a non-metal species (X) from a material comprising a metal, a semi-metal, a metal compound or a semi-metal compound ($M^1X$) in the solid state by a two-stage process, wherein the first stage comprises electrodeoxidation and wherein the second stage comprises connecting the material electronically to a different, reactive metal ($M^3$) while the material is in contact with a melt comprising a fused salt or a mixture of salts and the different, reactive, metal is in contact with or in solution in the melt, the different, reactive, metal forming a more stable compound ($M^3X$) with the non-metal species (X) than does the metal or semi-metal ($M^1$), wherein the first stage is discontinued after a portion of the non-metal species (X) has been removed from the solid material and before a sufficient portion of the non-metal species has been removed from the solid material to produce a desired product, the desired product being formed only after removal of a further portion of the non-metal species during the second stage of the process.

29. The method according to claim 28, wherein the removal of the non-metal species (X) from the material results in producing the metal or semi-metal ($M^1$).

* * * * *

UNITED STATES PATENT AND TRADEMARK OFFICE

CERTIFICATE OF CORRECTION

PATENT NO. : 7,879,219 B2
APPLICATION NO. : 10/497567
DATED : February 1, 2011
INVENTOR(S) : Fray et al.

It is certified that error appears in the above-identified patent and that said Letters Patent is hereby corrected as shown below:

Column 9,
Line 54, "$O+2e^{-}32\ O^{2-}$" should read --$O + 2e^{-} = O^{2-}$--.

Signed and Sealed this
Seventh Day of June, 2011

David J. Kappos

David J. Kappos
*Director of the United States Patent and Trademark Office*